US007370599B1

(12) United States Patent
Berman et al.

(10) Patent No.: US 7,370,599 B1
(45) Date of Patent: May 13, 2008

(54) MULTI-PURPOSE BOAT TOWER

(75) Inventors: Ron Berman, Port Orange, FL (US); Harry Wood, Edgewater, FL (US)

(73) Assignee: Boston Whaler, Inc., Edgewater, FL (US)

( * ) Notice: Subject to any disclaimer, the term of this patent is extended or adjusted under 35 U.S.C. 154(b) by 0 days.

(21) Appl. No.: 11/555,425

(22) Filed: Nov. 1, 2006

(51) Int. Cl.
*B63B 17/00* (2006.01)

(52) U.S. Cl. ..... 114/364

(58) Field of Classification Search ..... 114/364, 114/253; 224/406
See application file for complete search history.

(56) References Cited

U.S. PATENT DOCUMENTS 3,925,836 A 12/1975 Simmonds
3,949,698 A 4/1976 Sell
5,673,507 A 10/1997 Stokes
5,901,890 A 5/1999 Stokes
6,554,170 B1 4/2003 Correll et al.
6,666,159 B2 * 12/2003 Larson et al. ..... 114/253
6,866,001 B1 3/2005 Cuccia
2006/0037527 A1 * 2/2006 Aff ..... 114/364

* cited by examiner

*Primary Examiner*—Stephen Avila
(74) *Attorney, Agent, or Firm*—Malin Haley DiMaggio Bowen & Lhota, P.A.

(57) ABSTRACT

A multi-purpose boat tower comprising a unitary device with discrete and integral components including a rigid frame cage mounted to a portion of the deck and transom of a boat, a horizontal platform removably mounted to the top of the rigid frame, a plurality of foldable rack structures mounted to the rigid frame, a plurality of fishing rod holders mounted to the rigid frame and a rigid pylon structure mounted to the top of the rigid frame.

15 Claims, 8 Drawing Sheets

MULTI-PURPOSE BOAT TOWER

BACKGROUND OF THE INVENTION

1. Field of the Invention

The present invention relates generally to the boating industry. It relates more specifically to a unitary multi-functional, multi-activity aft boat tower for use in water sports, as well as fishing.

2. Description of Related Art

Boat tower designs have heretofore been utilized for elevated fishing towers, such Tuna Towers, Marlin Towers, and the like. They have also been designed as functional arches for radar and communication equipment, and further have attempted to address the problem of increasing the amount of space on boat decks as boaters seemingly increase the number of items brought onto a boat. However, prior attempts to address specific problems or to increase the efficient use of space are faulty in application and/or impractical from the standpoint of engineering designs. The attempts found in the prior art have addressed the general principles concerning storage of items, however, the recent emergence of the wakeboard industry has created a demand for structures which safely and effectively store wakeboards on boats that are powered by outboard engines. The industry also sees that operators of smaller boats often use the boats for a variety of activities which include numerous different watersports as well as fishing. The prior art has not addressed the need for a unitary structure which combines the requirements of watersport enthusiasts, including the storage of wakeboards or skis, includes a ski tow pylon, and yet also accommodates fishermen who require fishing rods and accessory items, as well as an elevated poling platform often used in fishing in a flats boat or alternative sporting boat.

The prior art has attempted to solve the problems in a variety of ways. For example, U.S. Pat. No. 3,928,836 issued to Simmonds on Dec. 16, 1975 entitled "TRANSOM MOUNTED SKI RACK AND TOW ROPE REEL SUPPORT" teaches a transom mounted structure that has two vertical tubular pieces with a plurality of devices that allow water skis to be stored transversely of the boat transom. The Simmonds patent also includes a device which provides a water ski tow rope reel and a boarding ladder. However, the Simmonds patent does not provide the ability to combine storage of water sports equipment with fishing equipment and with a sturdy structure allowing a user to stand atop it to see from an elevated position.

U.S. Pat. No. 5,673,507 issued to Stokes, Jr. on Oct. 7, 1997 entitled "APPARATUS FOR MOUNTING TROLLING DEVICES ON A WATERCRAFT" illustrates a support apparatus specifically used for the type of fishing known as "trolling". The structure inserts into the fishing rod holders located at the aft portion of a boat and contains devices for holding rods upright, outrigging devices, and downrigging devices.

U.S. Pat. No. 5,901,890 issued to Stokes on May 11, 1999 entitled "SCUBA GEAR RACK FOR WATERCRAFT" discloses a support rack specifically designed to hold scuba gear, such as several dive tanks, lights, radar, spear guns and a dive flag. The support removably mounts to a watercraft.

U.S. Pat. No. 6,554,170 issued to Correll et al. on Apr. 29, 2003 entitled "BOAT ACCESSORY RACK" teaches a boat accessory rack that is comprised of a number of interconnecting pieces which are adjustable in height, width and length. The Correll patent discloses specific legs in the boat accessory rack which are telescoping and are fixed in a certain length through clamping devices. The Correll patent also contemplates the inclusion of a hitch to allow for towing water skiers. The method in which the accessory rack in the Correll patent desires to be mounted to a boat, is through a series of ball joints that are removable from mounts located on the boat itself. This allows the rack in the Correll patent to be readily removed from the boat when desired. The use of ball joints also allows the rack to be rotatable 360 degrees with respect to the mount and pivotable by up to 180 degrees with respect to the mount.

U.S. Pat. No. 6,866,001 issued to Cuccia on Mar. 15, 2005 entitled "BOAT FOLD-AWAY TRANSPORT PLATFORM" teaches a fold-away transport platform pivotally attached to the stern of a boat. The platform is also attached to an internal surface of a boat through pivoting stern hinge brackets, thus allowing the platform to extend outwardly from the stern and fold upward into the interior of the boat for storage.

U.S. Pat. No. 3,949,698 issued to Sell on Apr. 13, 1976 entitled "ADJUSTABLE SKI HATCH" relates to an accessory attached to the transom of a boat that provides a tow rope attachment and a plurality of telescopingly engaged tubular members which allow the accessory to be extended in height and width.

Accordingly, what is needed in the boating industry is an improved integral and unitary boat tower that has multiple functions for a variety of distinct activities. It is desired that such an improved boat tower would have a frame enclosing and protecting an outboard engine and allows room for engine to move with out interference in all ranges of motion, does not interfere or impede seats or other deck features or equipment, has the structure to store wakeboards and water skis when they are not in use, includes and integral ski tow pylon, and yet simultaneously provides an elevated platform such that a user can stand atop the tower to maneuver the vessel through "poling", cast from the tower while fishing, and secure fishing rods for either storage or trolling. It is therefore, to the effective resolution of the aforementioned problems and shortcomings of the prior art that the present invention is directed. However, in view of the numerous and dissimilar boat towers and structures in the boating industry in existence at the time of the present invention, it was not obvious to those persons of ordinary skill in the pertinent art as to how the identified needs could be fulfilled in an advantageous manner.

SUMMARY OF THE INVENTION

The present invention contemplates an improved and modified boat tower, which includes a rigid framework mounted to the deck and transom of a boat and provides multiple uses for multiple distinct activities. The improved boat tower is designed to function with the aft seat of a boat as well as not conflicting with the outboard engine's trim and rotation motion. The improved boat tower combines the structure of a poling platform used with bay or flat boats, and certain features of a wake board tower typically found on a dual console water sport boat, in the central area of the hull or deck.

The improved design includes a rigid frame structure most likely composed of brushed anodized aluminum or stainless steel. The frame could be any finish including a painted or power coated finish. The frame could also be made from a composite material such as a mold system. The frame structure has a first pair of two mounting plates which mount onto a horizontal surface near the transom of a boat. The mounting plates are spaced apart such that they are equidistant from an outboard engine located on the stern of a boat. A first generally U shaped frame extends upwardly from the first pair of mounting plates to a height above the outboard engine with a central horizontal portion of the first frame member extending across the top of the outboard engine. The frame structure has a second pair of two mounting plates which mount onto a vertical surface of the transom of the boat. The second pair of mounting plates are spaced apart equally as the first pair, but are mounted to positions below the first pair of mounting plates. The second generally U shaped frame member initially extends outwardly away from the transom and upwardly from the second pair of mounting plates to a height above the outboard engine level with the first frame member. The second frame member likewise includes a central horizontal portion extending across the top of the outboard engine. Alternatively, the aft mounting points may be mounted directly onto the horizontal deck surface of the transom such that the aft mounting points are level with the forward mounting points. The horizontal portions of the first and second frames are located at the same height and are the same length.

The first and second frame members are secured to one-another and stabilized with cross brace members at select intermediate positions. In one embodiment, each side of the vertical sections will be stabilized by two cross members and the horizontal section will be stabilized by three cross brace members. The cross members will most likely be brushed anodized aluminum or stainless steel, structural foams or composites, and bonded or welded to each frame members. However, it is contemplated that the cross members may be selectively connected between the generally U shaped frame members at alternative locations and through alternative connection means.

A pylon structure, used for attaching a tow rope for wakeboarding or water skiing, is mounted to the horizontal section of the second frame structure. The pylon may be a short protruding tubular member, with an integral recess or enlarged head, which secures a tow rope when in use, but allows the tow rope or ski line to be easily removed.

In an alternative embodiment a rigid platform is mounted across the generally horizontal sections of the first and second frame members. The platform is designed or mounted in such a way that it does not interfere with the tow pylon, which remains exposed and available for use. The platform has multiple purposes, including an observation tower for navigation, viewing landmarks, or seeking fish, as well as casting during fishing and maneuvering the vessel through poling, much like a pole platform found on bay or flats boats. Thus, the frame structure provides a protective cage for the outboard motor, provides substantial support for the platform, and the entire device is rigid and sturdy enough to support the weight and activities of a user.

The improved design is further equipped with several integral and discrete components, such as rotatable/foldable rack structures mounted onto select cross members located between the vertical sections of the frame structure. The rack structures are most likely equipped with multiple elongated prongs, are rotatable positionable about the frame cage, from an extended position when in use to secure and hold a wakeboard or ski, to a retracted position near or within the frame cage. Most likely, the rack structures will be mounted in side-by-side pairs along each side of the frame cage. The function of the rack structures will be to store wakeboards and/or water skis when they are not in use. When the rack structures are not in use, they can be rotated to a position within the frame structure, thus eliminating protruding fingers or prongs during general pleasure boating or fishing activities.

The frame structure may be further equipped with a plurality of fishing rod holders. The fishing rod holders will most likely be located along the outermost portion of the vertical sections of the second frame. The rod holders fulfill a variety of functions, such as securing fishing rods, gaffs, nets, flag and dive poles, and the like. Because of the placement of the holders on the outer extreme side of the frame cage, the equipment does not interfere or impeded occupants of the vessel. Of course a primary purpose of the holders is also for securing the rods while trolling for game fish.

In accordance with the instant invention, it is therefore an object thereof to provide an improved multi-use, multi-function boat tower for a variety of separate activities;

It is further an object of the invention to provide a unitary device, with separate and integral components to secure distinct fishing and boating equipment, yet do so in a cost effective and operational efficient manner; and In accordance with these and other objects which will become apparent hereinafter, the instant invention will now be described with particular reference to the accompanying drawings.

DETAILED DESCRIPTION

The instant invention has been shown and described herein in what is considered to be the most practical and preferred embodiment. It is recognized, however, that departures may be made therefrom within the scope of the invention and that obvious modifications will occur to a person skilled in the art.

Figure 1:
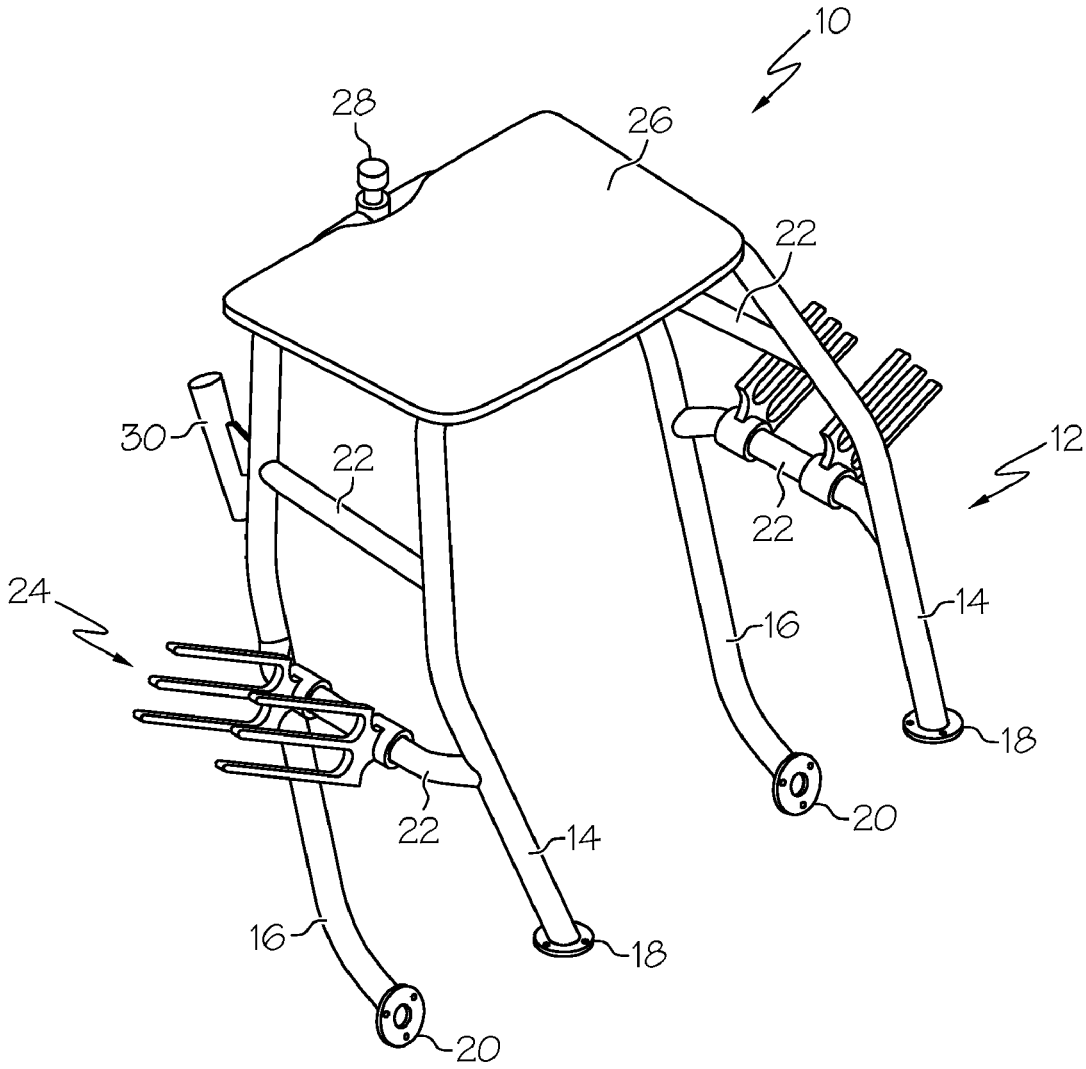
FIG. 1 shows a perspective view of the boat tower detached from the transom of a boat with the platform installed and pairs of the rotatable/foldable rack structures installed and extended outwardly from each side.

Turning to FIG. 1, a perspective view of the boat tower 10 is illustrated prior to installation on the deck and transom of a boat. Platform 26 is installed on the frame cage, and a pair of retractable or foldable rack structures 24 are mounted on cross brace members 22. They are shown in an extended position, being folded outwardly on each side. The boat tower 10 is comprised of a frame 12, which forms a protective cage or housing around the vessels outboard motor. In one embodiment, the frame 12 is comprised of a first tubular, generally U shaped, front segment 14 and a second tubular, generally U shaped, rear piece or segment 16. It can be appreciated that alternative cross-sectional geometric shapes or structure can utilized as frame members, such as I beams, rectangular struts, or the like. It is contemplated that the frame 12 is composed of brushed aluminum, however, alternative materials such as stainless steel, structural foams or composites may be used.

Front piece 14 has two generally vertical legs terminating at mounting ends. Each of the ends comprise mounting plates 18 that mount in a horizontal manner to a portion of the deck near the transom of a boat. The front segment 14 of the frame 12 is sized and shaped to fit over and around an outboard motor that has a trim and rotation motion.

The second rear frame segment 16 likewise has two legs terminating in mounting ends. Each of the ends includes mounting plates 20, which can be circular flanges, and mount in a vertical manner to a select position on the transom of a boat as further described hereinafter. It is also contemplated that the mounting points may be mounted in such a manner that the user may easily remove it when desired. For example, it is contemplated that an insertion mechanism is installed in the transom and the frame legs may be simply inserted and removed as desired.

The first frame front member 14 and second frame rear member 16 is secured to one-other through a plurality of cross brace members 22, thus forming the protective cage or housing of the invention. It is contemplated that at least two cross members will be utilized between the vertical legs of the front and rear frame members (a minimum of one on each side), and at least one cross member used between the horizontal segments of the front and rear frame members. As can be appreciated by one of ordinary skill in the art, if further stability is desired or required, more cross brace members 22 may be installed at multiple positions.

In a primary embodiment, it is contemplated that the cross members 22 will be arranged such that two cross members 22 will be installed on each side of the frame cage 12. The frame will further be equipped with a plurality of retractable racks 24 which are mounted onto select cross members 22. As illustrated in FIG. 1, the racks 24 can be mounted in pairs of two on a single cross brace, on each side of the frame 12; however, alternative locations and arrangements are possible. The boat tower 10 is further equipped with integral fishing rod holders 30 mounted onto the outer side of rear frame member 16. The design of the rod holders 30 can be the structure commonly used in the industry, or alternatively select shapes for receiving complementary accessory equipment for boaters, such as gaffs, telescoping nets with rectangular cross sections, and the like. The same is true for outriggers, downrigger support pods or shafts, or other equipment which can be quickly inserted or released from the holders.

The top of the boat tower 10 is equipped with a rigid flat platform 26. It is contemplated that the platform 26 is comprised of fiberglass or plastic, however, alternative composites or metallic materials may be used. The platform 26 is designed such that it will support the load of person stand on top of the platform 26, for a variety of activities. These include using the platform as an observation tower for sighting landmarks, schools of fish, aquatic life such turtles and porpoises, or signaling other vessels. Of course the platform is also used for "poling" or maneuvering a boat in shallow waters with the engine off and raised. Skiff, flats and bay boat operators often engage poling, as these boats have shallow drafts and are used near shoals, islands, keys and near shore waters.

The top of the boat tower 10 is further equipped with a tow pylon 28 that is mounted onto the top of the rear frame member 16. It is further contemplated that the pylon 28 can be mounted onto either the forward of aft end of the frame. The pylon 28 is used for towing water-skiers or wakeboarders. We should write this so that the pylon can be mounted on the forward or aft end of the frame to protect other configurations. It is contemplated that the tow pylon 28 is constructed of the same material as the frame 12, however, alternative materials may be used.

Figure 2:
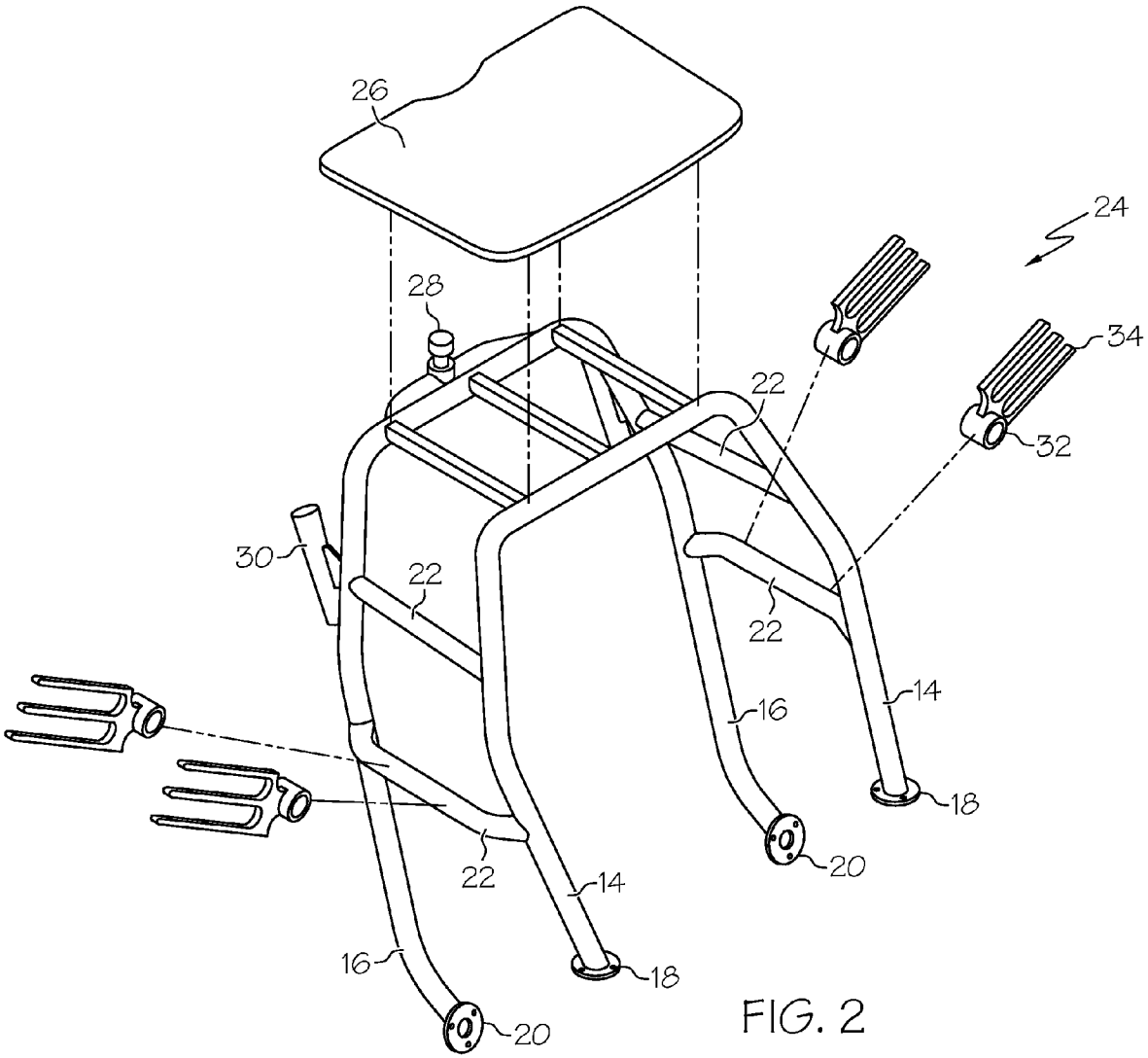
FIG. 2 shows an exploded perspective view of the boat tower illustrated in FIG. 1.

With reference to FIG. 2, an exploded perspective view of the boat tower 10 detached from the transom of a boat is shown. The racks 24 have a mounting end 32 which attached to the cross brace member 22. It is contemplated that the racks 24 are mounted such that it has the ability to rotate from a retracted or extended position, upwards and downwards. The racks 24 can have forked ends 34 which consist of multiple prongs. Racks 24 can have three prongs 34; however, an alternative number is also anticipated. Prongs 34 can be of different lengths, with the prong in the bottom position closest to the boat deck being the longest and the prong in the top position furthest from the boat deck being the shortest.

In one embodiment, racks 24 are mounted in pairs on one brace member, on each side of the frame cage, in order to provide a balanced storage structure for wakeboards and water-skis. In alternative embodiments, a single rack with shelves or elongated prong fingers for receiving skis or boards, could be utilized on a single cross brace. It is noted that with multiple prongs or fingers, each side of the frame cage can hold or secure 2 or more skis or boards, as long as any boots, if present, do not interfere with each other. For example, the skis could be slightly off set, or placed in the racks bottom-to-bottom.

Figure 3:
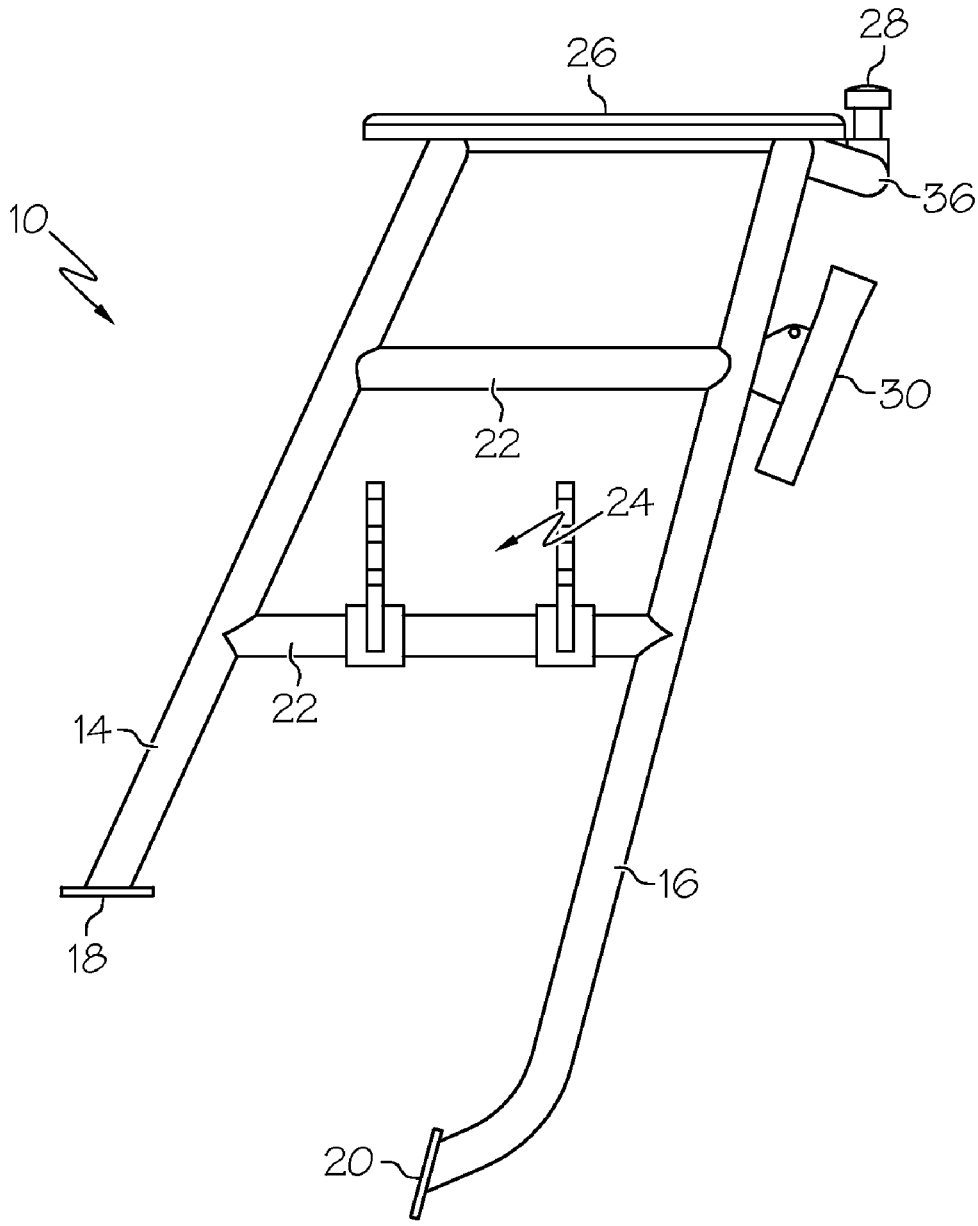
FIG. 3 is a side plan view of the boat tower frame and cage of the instant invention.

With reference to FIG. 3, a side plan view of the boat tower 10 is shown. In this embodiment, tow pylon 28 can be mounted onto a further upper frame arm 36, which is then mounted to the larger frame 12. The tow pylon 28 is preferably mounted near the back edge of the boat tower 10. As further shown, the frame 12 of the boat tower 10 has an angled shape which slopes slightly backward so as to be unobtrusive to boat occupants, avoid interfering with or impeding the vessel deck or equipment thereon, and to avoid unnecessary contact with an outboard engine around and over which the protective frame 12 is mounted. As further shown, the legs of the front generally U shaped frame member 14 terminate at a horizontal mounting plate 18 and the legs of the second generally U shaped rear frame member 16 terminate with vertical mounting plate 20.

Figure 4:
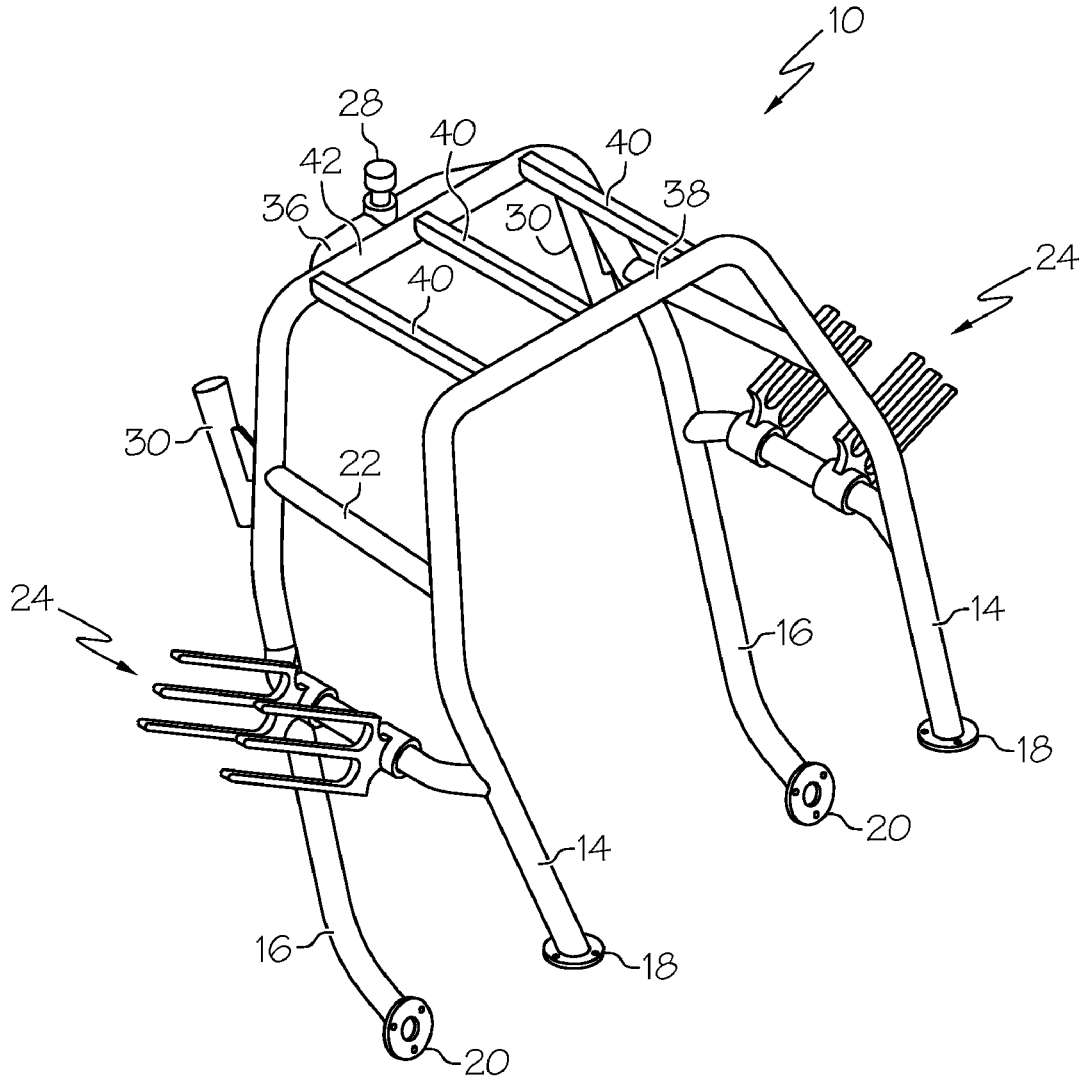
FIG. 4 illustrates an alternative embodiment of the invention illustrated in FIG. 1 with the platform removed.

With reference to FIG. 4, a front perspective view of the boat tower 10 is illustrated, wherein the rack structures 24 are extended or folded outwardly from the frame cage. In this position, the racks 24 shall be used to receive and secure water-skis and/or wakeboards which are not being used. The racks 24 are foldably attached to cross brace members 22 and rotate downwardly to a particular position at which the wakeboards and/or skis can be inserted between the prongs 34. In this embodiment, the platform is removed and not utilized. This design allows for upper cross brace members 40 to be used as a separate cargo rack assembly for securing or attaching further accessory, boating or fishing equipment, sporting goods and the like. Bungee cords, rope, quick release hooks or cleats can be used to attack the items to the top of the frame cage as desired.

Figure 5:
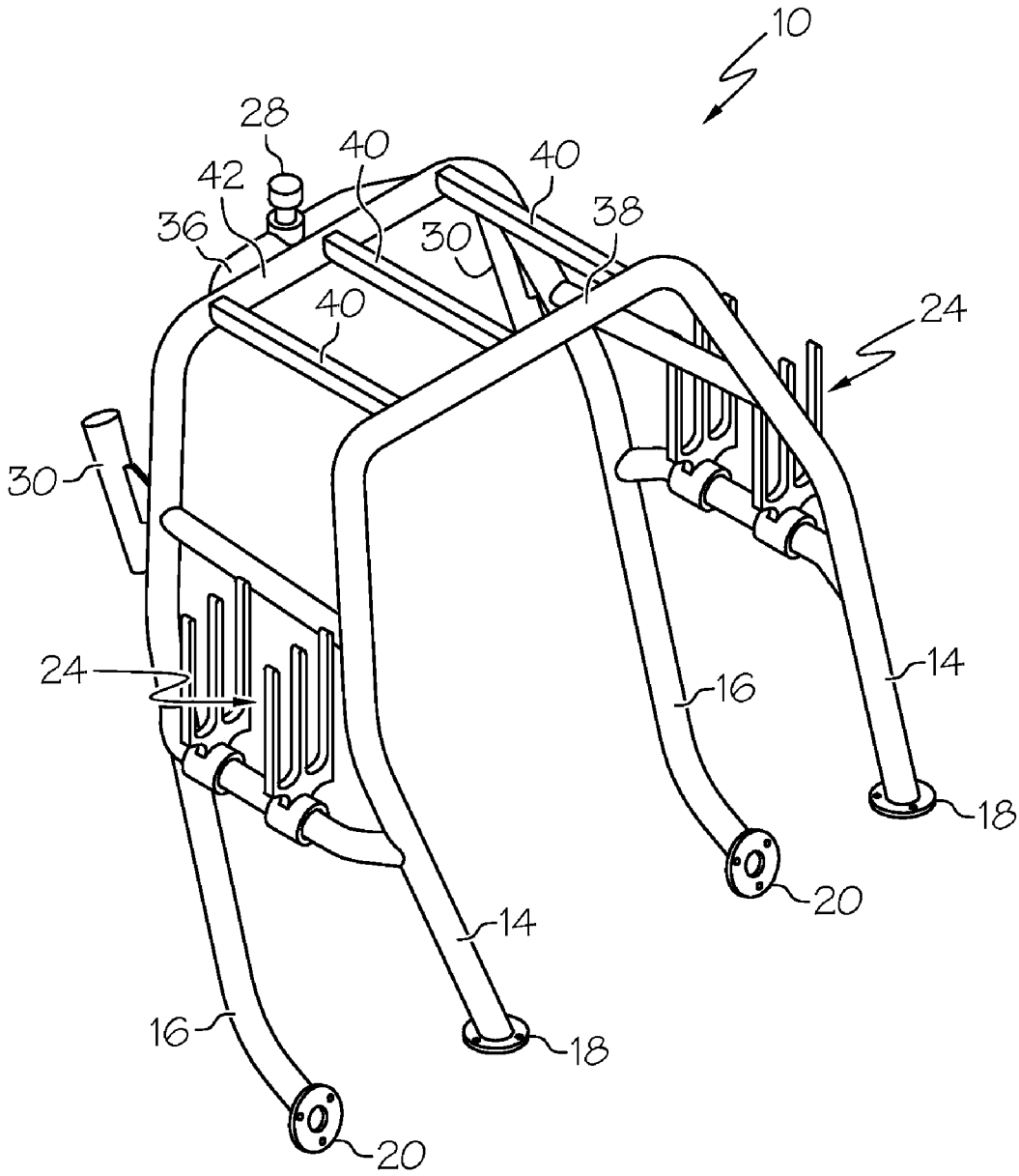
FIG. 5 shows a perspective view of the boat tower illustrated in FIG. 4, wherein the rack structures are retracted inwardly into the frame.

With reference to FIG. 5, a front perspective view of the boat tower 10 is shown, wherein the rack 24 are rotated and retracted inwardly into the frame 12. In this position, the rack structures 24 are not being used for storage of wakeboards and/or skis. When in the retracted position into the frame 12, the rack structures 24 do not obstruct the boat occupants or equipment for alternative uses of the boat tower, such as towing a water-skier with the pylon 28, storing or trolling with fishing rods placed within the fishing rod holders 30, or with person standing on top of the platform 26 (not shown). As shown, the top of the frame arm 38 is generally flat across and has cross members 40 between the first frame member 14 and second rear frame member 16. The platform 26 can also be mounted onto the cross members 40 and the top section 38 of the frame, as discussed above. It is contemplated that the platform 26 will be removably mounted.

Figure 6:
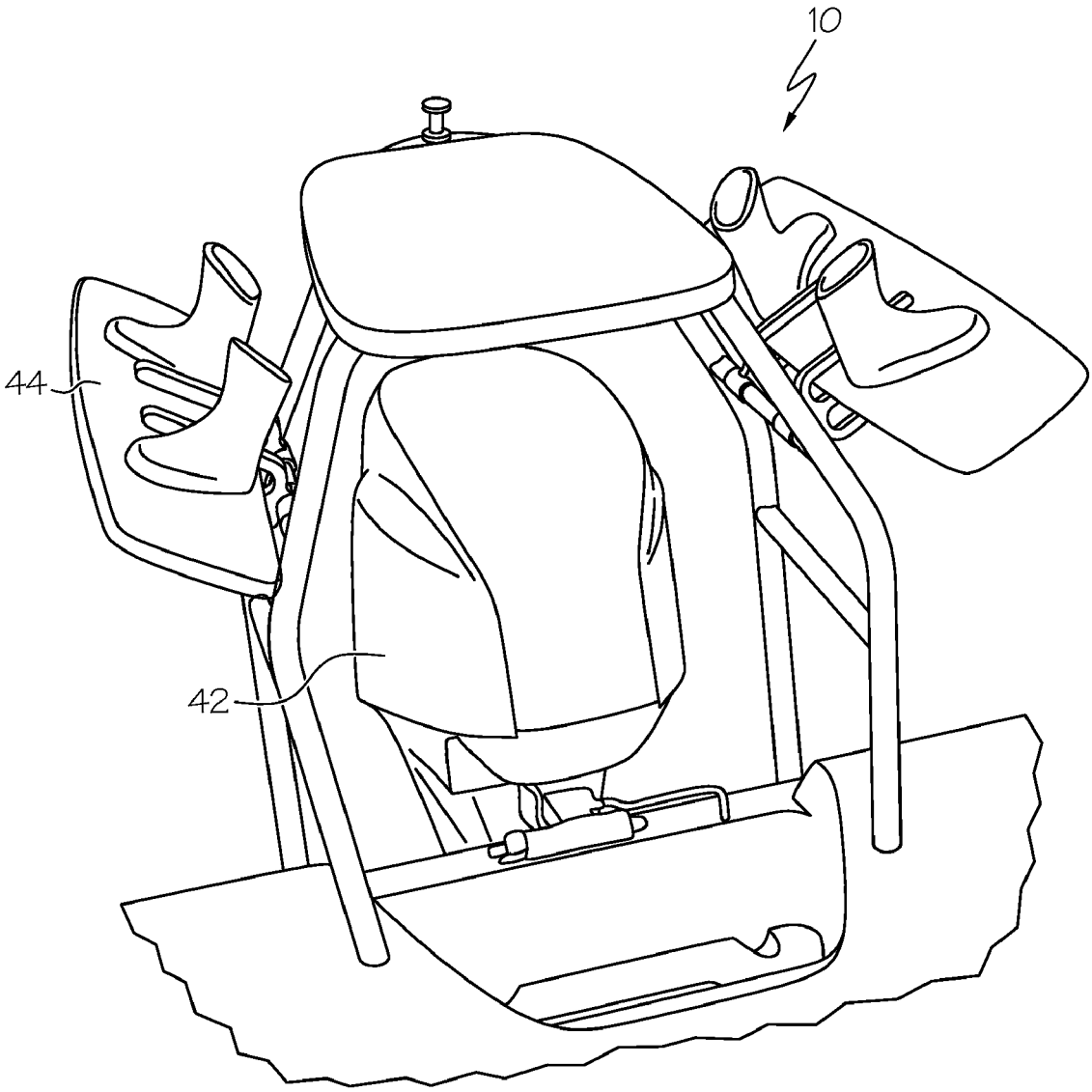
FIG. 6 illustrates a rearwardly facing perspective view of the boat tower mounted to the deck and transom of a boat, wherein the tower is mounted over an outboard engine and wakeboards are stored in the rack assemblies.

With reference to FIG. 6, a perspective rearward view of the boat tower 10 is shown, with the tower 10 mounted onto the transom and deck of a boat. Tower 10 is mounted over an outboard edge 42 and wakeboards 44 are stored in the uppermost prongs of racks 24. The racks are depicted in the extended or fold-down position as exemplified in FIG. 4. Also note the ski tow pylon 28, and the rod holders 30 comprise integral components of the improved frame cage, and are available for use by boaters.

Figure 7:
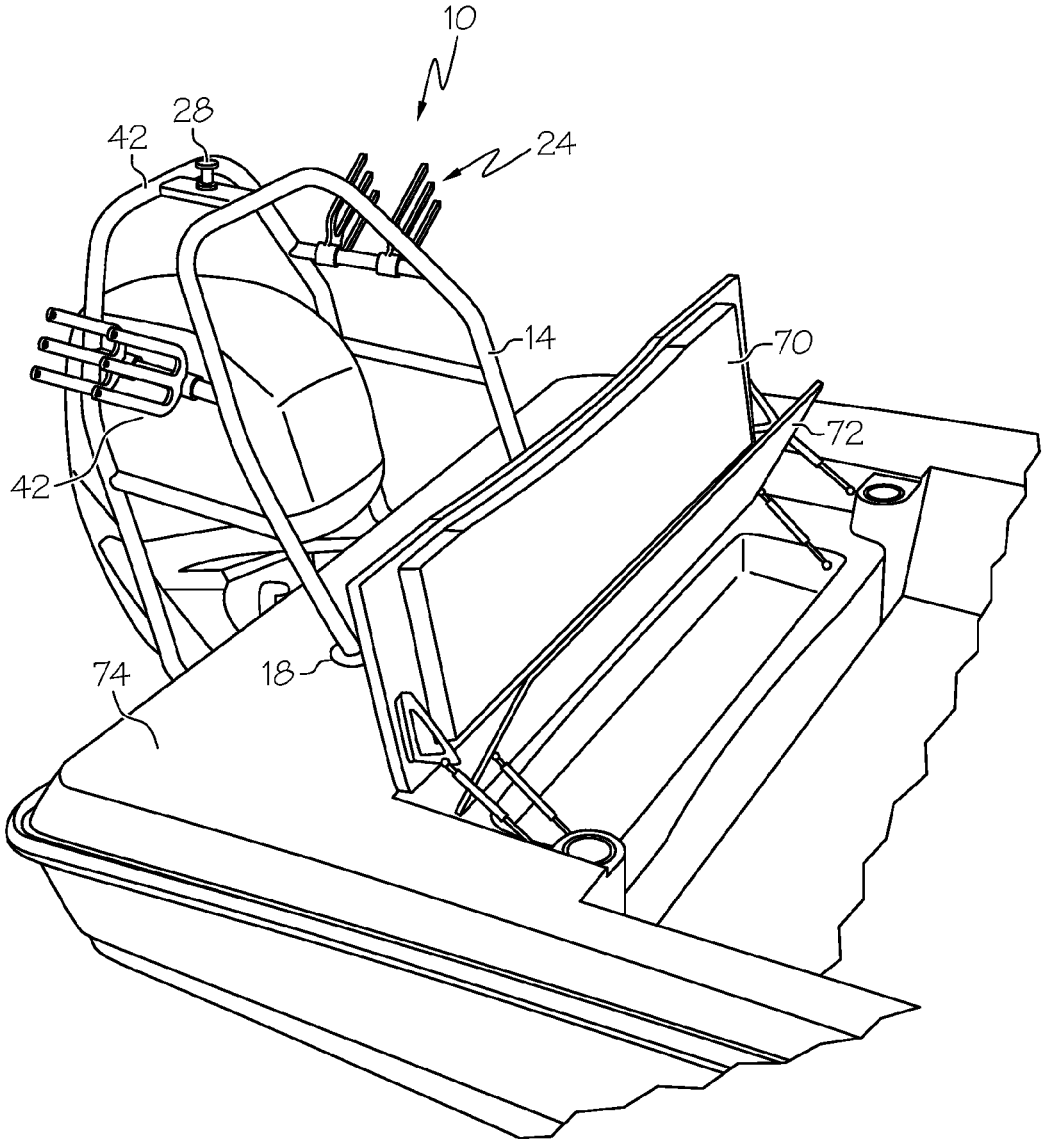
FIG. 7 illustrates a rearwardly facing perspective view of the boat tower mounted to the deck and transom of a boat, wherein the rear seat is shown to be folded upwardly without obstruction.

With reference to FIG. 7, a rearwardly facing perspective view of the boat tower 10 is shown with the tower 10 mounted onto the transom and deck 74 of a boat. In particular, FIG. 7 exemplifies the ability of the tower 10 to be mounted while maintaining the ability for the rear seating surface 70 and underlying storage top 72 to be opened and closed. This figure shows the seating surface 70 in the open position without obstructing, or being obstructed by, the tower 10.

Figure 8:
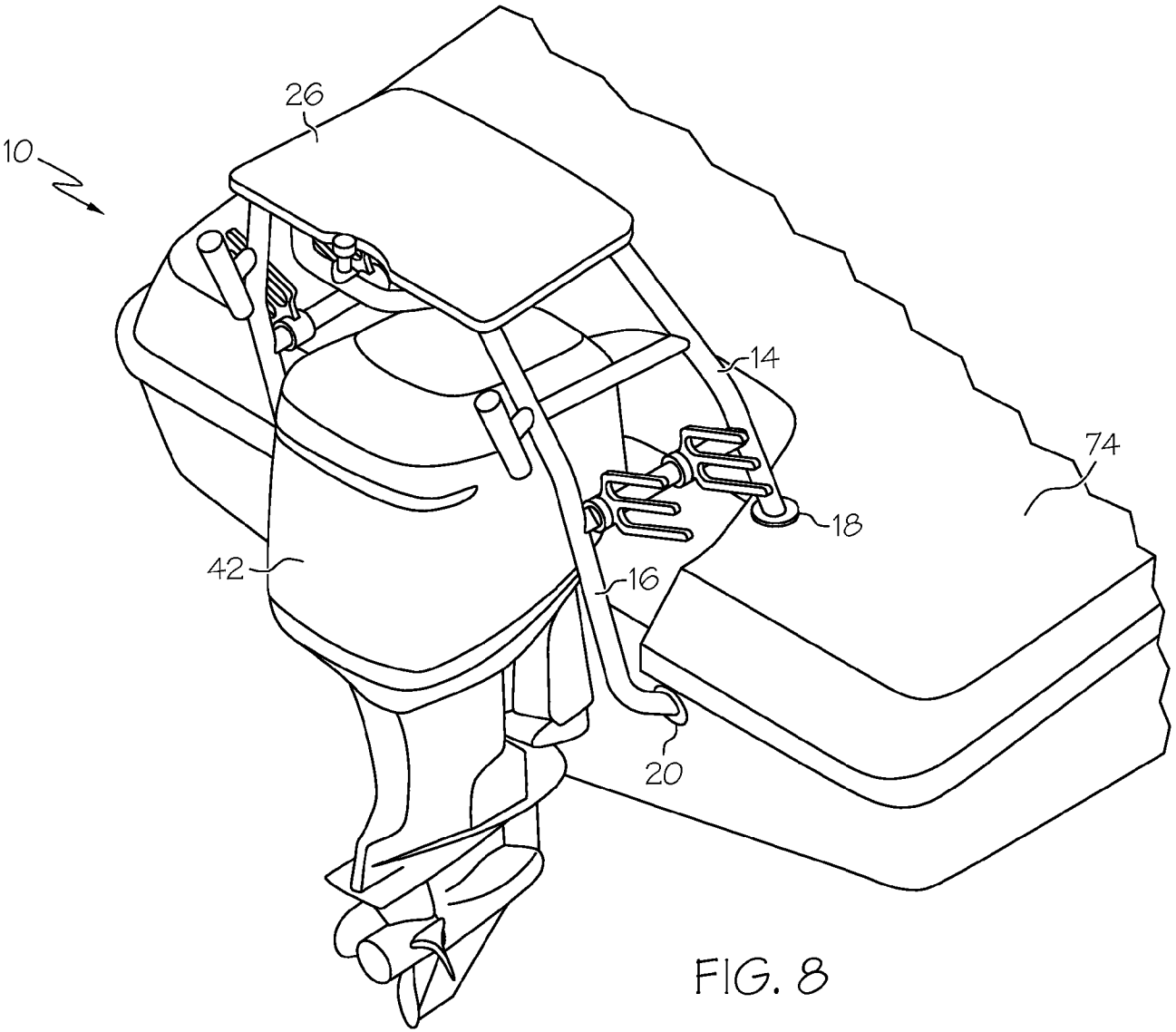
FIG. 8 illustrates a forwardly facing perspective view of the boat tower mounted to the deck and transom of a boat, showing the mounting plates on the horizontal and vertical surfaces of the boat.

With reference to FIG. 8, a forwardly facing perspective view of the boat tower 10 mounted to the deck and transom 74 of a boat, showing the mounting plates on the horizontal 18 and vertical 20 surfaces of the boat. The figure further exemplifies the placement of the tower 10 around and over the motor 42.

Applicant has disclosed and described a unique and improved multi-use boat tower, which constitutes a unitary device with multiple uses features and benefits. The instant frame cage comprises a rigid framework protecting and avoiding interference with the outboard motor, and includes integral yet discrete components to facilitate storage of skis, fishing and boating equipment, tow pylons and a rigid upper platform for multiple uses.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A multi-purpose boat tower comprising:

a rigid frame cage for mounting to an aft deck section and transom of a boat;

said frame cage including a plurality of rotatable rack structures mounted to the rigid frame cage;

a tow pylon mounted to the top of the rigid frame cage;

at least one rod holder mounted to the rigid frame cage;

said rigid frame cage being further comprised of a first generally U shaped frame member, and a second generally U shaped frame member, said first and second frame members being secured to one-another with a plurality of cross brace members;

a rigid platform;

said rigid frame cage including a generally horizontal center section;

said rigid platform being removably mounted to said horizontal center section;

wherein said rigid frame cage has a size and shape to accommodate and house an outboard motor;

wherein said rack structures are sized and shaped to receive and retain skis and wakeboards; and the frame cage and integral components constituting a unitary device.

2. The multi-purpose boat tower in claim 1, wherein the plurality of rotatable rack structures are mounted to said cross brace members of said rigid frame cage.

3. The multi-purpose boat tower in claim 1, wherein each rotatable rack structure has a plurality of prongs for receiving skis and wakeboards.

4. The multi-purpose boat tower in claim 1, wherein the rigid frame cage is comprised of a plurality of tubular members forming said first and second generally U shaped frame members.

5. The multi-purpose boat tower in claim 1, wherein said first generally U shaped frame member is adapted to be mounted to an aft horizontal deck section of the boat, and said second generally U shaped frame member is mounted to a vertical surface of the transom of a boat.

6. The multi-purpose boat tower in claim 1, further comprising a plurality of rod holders mounted to the rigid frame cage.

7. A multi-purpose boat tower comprising:

a rigid frame cage for mounting to an aft deck section and transom of a boat;

said frame cage including a plurality of rotatable rack structures mounted to the rigid frame cage;

wherein the plurality of rotatable rack structures fold inwardly and outwardly in a vertical planar direction from the rigid frame cage;

a tow pylon mounted to the top of the rigid frame cage;

at least one rod holder mounted to the rigid frame cage;

said rigid frame cage being further comprised of a first generally U shaped frame member, and a second generally U shaped frame member, said first and second frame members being secured to one-another with a plurality of cross brace members;

wherein said rigid frame cage has a size and shape to accommodate and house an outboard motor;

wherein said rack structures are sized and shaped to receive and retain skis and wakeboards; and the frame cage and integral components constituting a unitary device.

8. A multi-purpose boat tower comprising:

a rigid frame mounted to the transom of a boat;

a platform structure removably mounted to the top of the rigid frame;

a plurality of foldable rack structures mounted to the rigid frame; and a rigid pylon structure mounted to the top of the rigid frame;

wherein said rigid frame is comprised of a plurality of horizontal and vertical pieces;

wherein said platform structure is mounted to horizontal pieces on the frame;

wherein the plurality of foldable rack structures are mounted to horizontal pieces on the sides of the rigid frame;

wherein each foldable rack structure has more than one elongated fork prong;

wherein said rigid frame has a size and shape to fit around and over an outboard motor;

wherein said rack structures are sized and shaped to hold skis and wakeboards;

wherein the plurality of foldable rack structures fold inwardly and outwardly in a vertical planar direction from the rigid frame.

9. The multi-purpose boat tower in claim 8, wherein the rigid frame is comprised of a plurality of tubular pieces mounted together.

10. The multi-purpose boat tower in claim 8, wherein the rigid frame is comprised of a plurality of tubular pieces removably interconnected with each other through connection means.

11. The multi-purpose boat tower in claim 8, wherein the rigid frame is mounted to the transom of a boat or both horizontal and vertical planar surfaces on the boat.

12. The multi-purpose boat tower in claim 8, further comprising a plurality of fishing rod holders mounted to the rigid frame.

13. A multi-purpose boat tower comprising:

a rigid frame mounted to the transom of a boat;

a platform structure removably mounted to the top of the rigid frame;

a plurality of foldable rack structures mounted to the rigid frame;

a plurality of fishing rod holders mounted to the rigid frame; and a rigid pylon structure mounted to the top of the rigid frame;

wherein said rigid frame is comprised of a plurality of horizontal and vertical pieces;

wherein said platform structure is mounted to horizontal pieces on the frame;

wherein the plurality of foldable rack structures are mounted to horizontal pieces on the sides of the rigid frame;

wherein each foldable rack structure has more than one elongated fork prong;

wherein said rigid frame has a size and shape to fit around and over an outboard motor;

wherein said rack structures are sized and shaped to hold skis and wakeboards;

wherein the plurality of foldable rack structures fold inwardly and outwardly in a vertical planar direction from the rigid frame;

wherein the rigid frame is mounted to the transom of a boat on both horizontal and vertical planar surfaces on the boat.

14. The multi-purpose boat tower in claim 13, wherein the rigid frame is comprised of a plurality of tubular pieces mounted together.

15. The multi-purpose boat tower in claim 13, wherein the rigid frame is comprised of a plurality of tubular pieces removably interconnected with each other through connection means.

* * * * *